United States Patent [19]

Warburton et al.

[11] Patent Number: 4,846,379

[45] Date of Patent: Jul. 11, 1989

[54] NOZZLE ASSEMBLY FOR A LIQUID DISPENSING MACHINE

[75] Inventors: Eric T. Warburton; Vincent J. Rouble, both of Peterborough, Canada

[73] Assignee: Innopac, Inc., Willowdale, Canada

[21] Appl. No.: 171,771

[22] Filed: Mar. 22, 1988

[51] Int. Cl.[4] ..... B67D 3/00; B65D 25/40; B65D 35/38

[52] U.S. Cl. ..... 222/482; 222/571; 222/495; 222/330; 137/516.11

[58] Field of Search ..... 222/108, 478, 481, 482, 222/488, 571, 495, 496, 497, 518, 330; 141/237, 242, 244, 245, 392, 387, 388, 116, 115; 137/516.11

[56] References Cited

U.S. PATENT DOCUMENTS

| | | | |
|---|---|---|---|
| 2,697,446 | 12/1954 | Harrington | 222/571 X |
| 3,906,850 | 9/1975 | Papai | 222/575 X |
| 3,913,801 | 10/1975 | Wise et al. | 222/482 X |
| 4,079,762 | 3/1978 | Hanson, Jr. | 141/392 X |
| 4,394,945 | 7/1983 | Taylor, Jr. | 222/571 |
| 4,505,298 | 3/1985 | Rasmussen | 222/571 X |

FOREIGN PATENT DOCUMENTS

| | | | |
|---|---|---|---|
| 29916 | 7/1913 | Norway | 141/244 |
| 61719 | 12/1937 | Norway | 141/237 |

*Primary Examiner*—Joseph J. Rolla
*Assistant Examiner*—Mona Beegle
*Attorney, Agent, or Firm*—Ridout & Maybee

[57] ABSTRACT

A nozzle assembly for dispensing measured volumes of a liquid has a valve for dividing an inflowing volume of liquid into a plurality of equal outflowing aliquots through the use of a radial spreading zone in the valve. The valve is connected to a plurality of nozzles which dispense the liquid into containers. The nozzles each have a sump and a plurality of outlet nipples to eliminate dripping of liquid from the nozzle during valve drawback.

41 Claims, 2 Drawing Sheets

NOZZLE ASSEMBLY FOR A LIQUID DISPENSING MACHINE

The present invention is a nozzle assembly for a liquid dispensing machine. The nozzle assembly of the invention is useful for dispensing measured amounts of a liquid from a pumped liquid supply to containers conveyed beneath the nozzle as, for example, in the operation of a filling machine. The invention has particular application in a filling machine for an edible liquid.

When designing a nozzle for the distribution of a single liquid input flow to a plurality of measured output flows, a number of problems are encountered. Depending on the application, the division of the liquid input volume into a plurality of equal output volumes for simultaneous dispensing into containers is a principal concern.

The division of the liquid input into equal aliquots must be rapid and unerring in most edible liquid applications since container filling proceeds at a high rate and spillage due to overfilling can lead to bacterial growth with consequential down time for machine cleaning.

Nozzle assemblies of the type herein described are used in association with a pumped liquid source. The stroke of the liquid pump and the consequent operation of the valve causes a drawing back or suction of liquid in the nozzle as the valve closes. In prior nozzles this pressure cycling caused drops of liquid to form at the nozzle outlets which resulted in dripping of liquid onto the conveyor of the machine resulting in contamination requiring expensive down time to remedy.

Spillage and dripping of liquids onto the filling machine is a particular problem when working with dairy products. Milk and cream are especially susceptible to rapid promotion of bacterial growth, so extreme care is needed in a dairy product filling operation to minimize down time due to spills or drips. When the filling machine is down for cleaning, it is important that the nozzle assembly be readily cleanable without the need to disassemble it.

A nozzle assembly according to the present invention addresses all of the foregoing points by providing a rapid and equal division of the input liquid volume into the required plurality of output volumes.

The present nozzle assembly eliminates drips at the nozzle outlets when the residual liquid in the nozzle is not under positive pressure. The entire nozzle assembly comprising the valve body and nozzle, may be cleaned and sterilized by providing a flow of pressurized steam through it.

Accordingly, the present invention provides a nozzle assembly for dispensing measured volumes of a liquid, comprising a valve body having inlet means for the liquid at a first end and outlet means for a plurality of liquid streams at a second end thereof. The valve body defines a valve bore extending from the inlet means to a radial spreading zone adjacent the outlet means, so that liquid flowing through the valve body proceeds through the inlet means, valve bore and radial spreading zone before exiting through the outlet means. A valve is seated in the valve bore of the valve body, and the valve coacts with bias means for biasing the valve toward closure of the inlet means. A plurality of nozzles are connectable to the outlet means of the valve body, each nozzle having a bore extending from an inlet to a sump, and having a plurality of radially disposed outlet nipples in flow communication with the sump.

Figure 1:
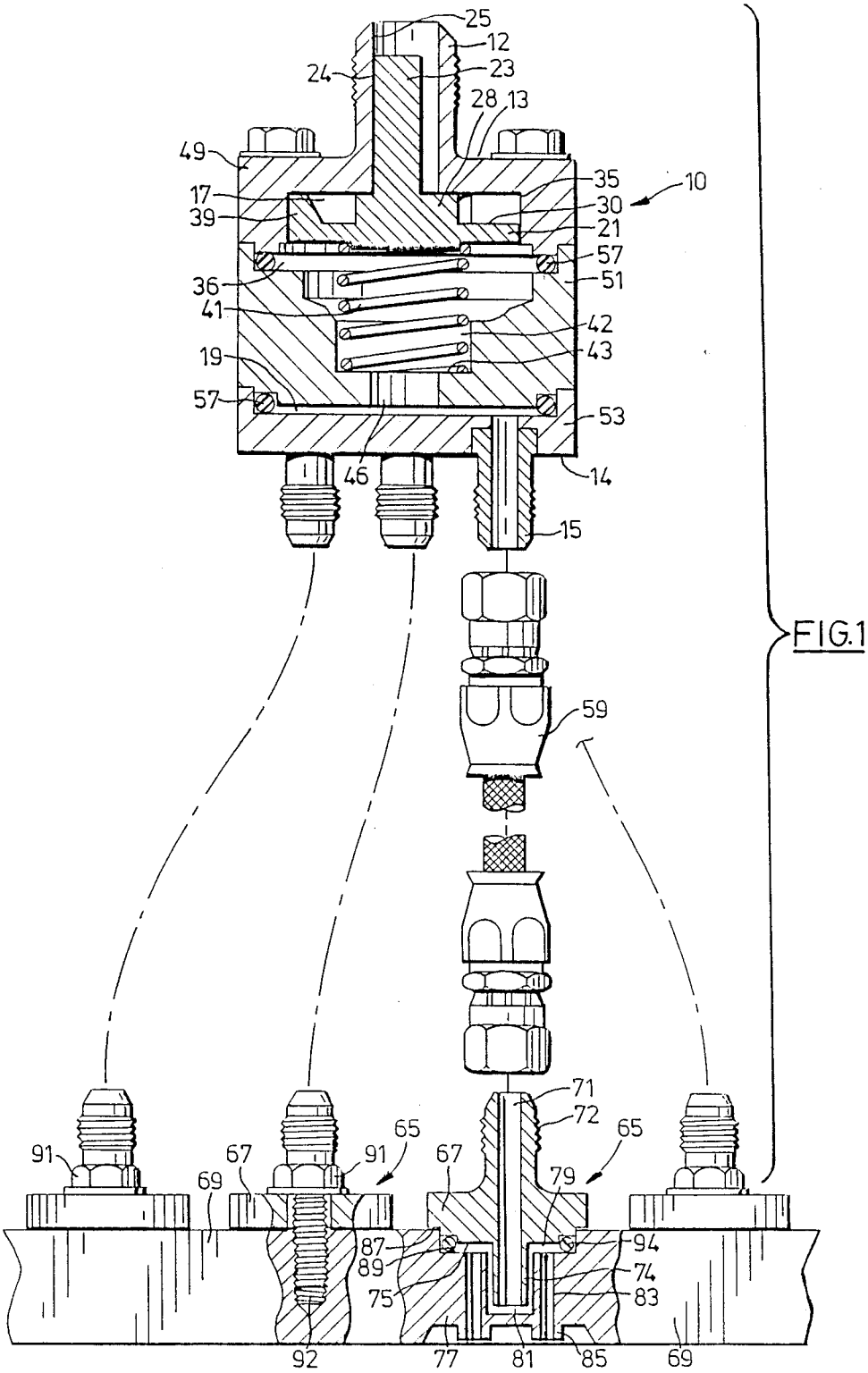
FIG. 1 is a side cross sectional view of the nozzle assembly showing hose connections between the valve body and nozzles.

The nozzle assembly of the invention comprises a valve body 10 having inlet means for a liquid, the inlet means preferably being a tubular, threaded hose fitting 12 formed in the top 13 of the valve body 10. The bottom 14 of the valve body 10 has outlet means for the liquid, the outlet means preferably being a plurality of tubular threaded hose fittings 15. The interior space of the valve body 10 defines a valve bore 17 extending from the inlet 12 to a radial spreading zone 19 formed adjacent to the outlets 15.

Figure 2:
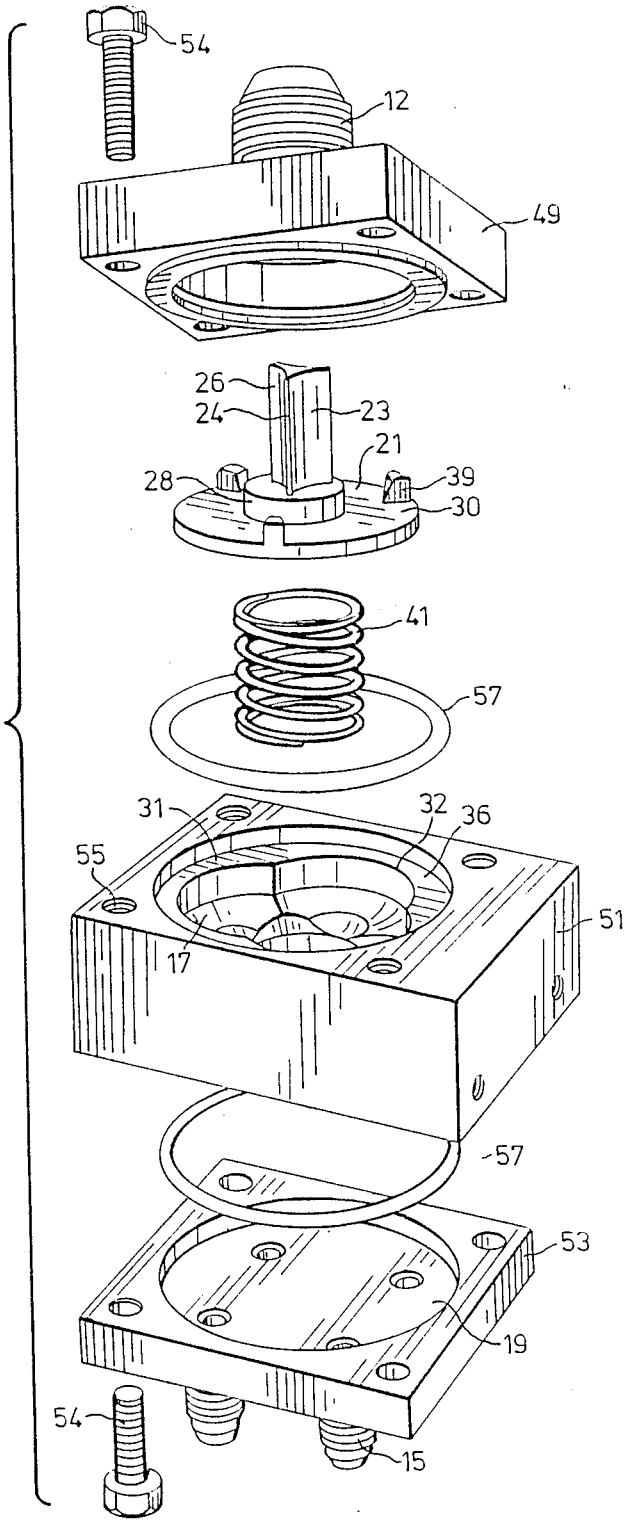
FIG. 2 is an exploded perspective view of the valve body of the assembly.

A valve 21 is seated in the valve bore 17 of the valve body 10. The valve 21 comprises a valve stem 23 which extends into the tubular inlet 12 and which preferably has three surfaces or edges 24 engageable with the inner surface 25 of the inlet 12. As shown in FIG. 2, the valve stem 23 preferably has a tricuspidal cross section defining three ribs 26 radiating from the center of the stem 23, each rib 26 having a longitudinal edge 24 extending the length of the stem 23 so that the longitudinal edges 24 may engage the inner surface 25 of the inlet 12, thereby providing guidance for the travel of the valve 21 when opening and closing while allowing ample through space in the tubular inlet 12 to permit the required liquid flow rate.

The valve 21 has a valve head 28 which in the closed position seats about the inlet 12 opening into the valve bore 17, thereby closing the inlet 12. The valve head 28 steps down to a stop plate 30 which is engageable with cusps 31 (FIG. 2) formed in the valve bore 17 beneath the valve 21 to restrict the travel of the valve 21 in the open position. The valve bore 17 immediately beneath the valve 21 is preferably trilobate in shape with the cusps 31 formed at the intersections of adjacent lobes 32 providing platforms for engaging the bottom surface of the stop plate 30 on the downward stroke of the valve 21. The diameter of the stop plate 30 is great enough to enable secure engagement of the plate 30 with the cusps 31 but small enough to provide passageways for the liquid around the plate 30 and down the bore 17 through the lobes 32.

As seen in FIG. 1, the valve bore 17 has an upper portion 35 with a diameter approximating that of the stop plate 30. Beneath the upper portion 35 is a portion 36 having a greater diameter than the stop plate 30 so that liquid can flow around the plate 30 and down the lower portion of the bore 17 to the outlets 15. In order to ensure the accurate return of the stop plate 30 to the upper bore portion 35 on the upward stroke of the valve 21, the plate 30 is provided with a plurality, preferably three, of valve guides 39 spaced about the circumference of the plate 30. The guides 39 extend upwardly from the plate 30 into the upper bore portion 35 providing a continuous engagement of the valve 21 with the inner surface of the bore portion 35 during both the upward and downward stroke of the valve 21.

The valve 21 is biased toward the closed position, that is, with the valve head 28 closing the inlet 12, by bias means, which in the preferred embodiment is a spring 41 positioned in the lower portion 42 of the bore 17. The spring 41 is preferably a coil spring conforming to the diameter of the lower bore portion 42 and coacting with the annular floor 43 of the bore portion 42 and the underside of the stop plate 30 to provide a biasing force for the valve 21 toward the closed position.

The valve bore 17 is connected to the radial spreading zone 19 by an aperture 46 through the floor 43. The radial spreading zone 19 provides a flat circular space for an even accumulation of a relatively small volume of liquid at the openings of the outlets 15. The outlet hose fittings 15 are equally or symmetrically radially spaced from the center of the spreading zone 19. This arrangement of outlets 15 extending from the radial spreading zone 19 provides a simple means for dividing the incoming volume of liquid into equal aliquots according to the number of outlets 15. For most filling applications the preferred number of outlets 15 is four to six.

As shown in the drawings, the valve body 10 is preferably assembled from three pieces fastened together. Thus, an upper valve inlet member 49 comprises the inlet hose fitting 12 and upper valve bore portion 35. A valve block 51 defines the central and lower valve bore portions 36 and 42 as well as the aperture 46, and a radial spreader plate 53 defines the radial spreading zone 19 and outlet hose fittings 15. The inlet member 49 and the spreader plate 53 are both preferably attached to the valve block 51 by bolts 54 securable in threaded bores 55 formed in the valve block 51. The valve body 10 is sealed at the junctions of the three pieces 49, 51 and 53 by O-rings 57.

In operation, the valve body 10 is attached at the inlet hose fitting 12 to a pumped source of liquid, and at the outlet hose fittings 15 by hoses 59 to a plurality of nozzles 65 which dispense the liquid into containers conveyed along beneath the nozzles 65. The pumped liquid is provided to the valve body 10 in a series of pressure surges. Each pressure surge of liquid through the inlet 12 causes the valve 21 to open or move away from its seat about the inlet 12. Liquid then flows past the valve 21 and down the valve bore 17 through the lobes 32, the lower portion 42 and the aperture 46. Upon entering the radial spreading zone 19, the hydraulic pressure of the liquid causes it to spread evenly throughout the zone 19 so that equal volumes of liquid may then exit the valve body 10 through the plurality of radially spaced outlet hose fittings 15. On the back stroke of the pump, the hydraulic pressure forcing the valve 21 open is no longer sufficient to overcome the biasing force of the spring 41, so the valve 21 is closed by the spring 41.

While this cyclical hydraulic force allows the valve body 10 of the invention to operate smoothly to divide an incoming volume of liquid into a plurality of equal outflowing volumes, the hydraulic pressure cycles present a special problem for clean dispensing of the liquid at the nozzles 65. When the valve 21 draws back to the closed position, the liquid in the assembly downstream of the valve 21 is also drawn back slightly. At the outlet end of each nozzle 65, this drawback usually causes the formation of a drop of liquid which is apt to separate from the nozzle outlet when there is no receptacle beneath the nozzle 65, thus contaminating the machinery associated with the nozzle assembly. In some filling applications, such as for dairy products, dripping from the filling nozzles 65 quickly results in unacceptably high levels of bacterial growth on the machinery requiring costly down time for steam cleaning of the machinery.

The nozzles 65 of the present invention overcome this dripping problem by providing a two piece construction for each nozzle 65, comprising an inlet member 67 and a nozzle plate 69 (see FIG. 1). The inlet member 67 defines a bore 71 extending through it preferably from a hose fitting 72 at one end of the member 67 to a tubular portion 74 which extends downwardly beyond the bottom surface 75 of the inlet member 67.

The nozzle plate 69 is preferably fabricated to accommodate the desired array of nozzles 65 by providing a plurality of nozzle outlet means 77 each of which coacts with an inlet member 67 to form a nozzle 65. As shown in cross section in FIG. 1, each nozzle outlet means comprises an upper annular recess 79 having a central sump 81. A plurality of outlet tubes 83 are spaced radially about the sump 81, each outlet tube 83 extending from the bottom of the annular recess 79 to an outlet nipple 85 at the bottom of the nozzle plate 69.

The inlet member 67 has a circular flange 87 engageable with the top of the nozzle plate 69 about the annular recess 79 so that the tubular portion 74 of the inlet member 67 extends substantially into the sump 81 preferably terminating near the bottom of the sump 81 and providing an annular clearance between the tubular portion 74 and the wall of the sump 81. This assembly of the inlet member 67 and the nozzle plate 69 also provides a clearance between the bottom surface 75 of the inlet member 67 and the floor 89 of the recess 79. This arrangement provides a flow pathway for fluid entering the nozzle 65 through the bore 71, sump 81, annular recess 79 and outlet tubes 83. The inlet members 67 are preferably attached to the nozzle plate 69 by bolts 91 screwed into threaded bores 92 provided in the nozzle plate 69. A liquid seal for the assembled nozzle parts 67 and 69 is provided by an O-ring 94 in each annular recess 79.

In operation, the liquid flows through the nozzles 65 under positive hydraulic pressure from the pump. Upon drawback of the valve 21 to the closed position, liquid in the outlet tubes 83 is drawn back into the sump 81, thereby preventing dripping of liquid from the nozzle outlets 83. Liquid drawback into the sump 81 is facilitated by use of the plurality of outlet tubes 83, four to six tubes 83 being preferred. The nipples 85 formed at the end of each outlet tube 83 discourages the formation of droplets at the outlet ends. Since the outlet tubes 83 are cleared of liquid upon closure of the valve 21, there is also no dripping from the nozzles 65 when the filling operation is placed on hold.

The foregoing description relates to a preferred embodiment of the invention suitable for use in a filling machine for an edible liquid such as a dairy product. The foregoing description is not intended to restrict the scope of the invention which is defined in the following claims.

I claim:

1. A nozzle assembly for dispensing measured volumes of a liquid comprising:

a valve body having valve inlet means for the liquid at a first end and valve outlet means for a plurality of liquid streams at a second end thereof, the valve body defining a valve bore extending from the valve inlet means to a radial spreading zone adjacent the valve outlet means, the valve inlet means being a tubular hose fitting and the valve outlet means being a plurality of tubular hose fittings;

a valve seated in the valve bore of the valve body and coacting with bias means for biasing the valve toward closure of the valve inlet means;

a plurality of nozzles are connected to the valve outlet means, each nozzle having a bore extending from a nozzle inlet to a sump and having a plurality of radially disposed nozzle outlet nipples in flow communication with the sump.

2. A nozzle assembly as claimed in claim 1, wherein the valve outlet means comprises 4, 5 or 6 tubular members extending from the second end of the body.

3. A nozzle assembly as claimed in claim 1, wherein the valve bore of the valve body defines an upper cylindrical zone adjacent the valve inlet means, a central zone having a plurality of lobes intersecting at cusps, and a lower cylindrical zone having an aperture opening to the radial spreading zone.

4. A nozzle assembly as claimed in claim 1, wherein the radial spreading zone is a flat circular space adjacent the valve outlet means.

5. A nozzle assembly claimed in claim 1, wherein the valve has a stem extending from a valve head into the valve inlet means.

6. A nozzle assembly as claimed in claim 5, wherein the valve stem is offset from the center of the valve head, the stem having at least one longitudinal edge which engages an inner surface of the valve inlet means.

7. A nozzle assembly as claimed in claim 3, wherein the valve has a valve head which in the closed position seats about the valve inlet means closing it.

8. A nozzle assembly as claimed in claim 7, wherein the valve has a circular stop plate stepped down from the valve head, the stop plate being sized to contact the cusps in the central zone of the valve bore when the valve moves to open the valve inlet means.

9. A nozzle assembly as claimed in claim 1, wherein the bias means is a spring.

10. A nozzle assembly as claimed in claim 3, wherein the bias means is a coil spring seated in the lower cylindrical zone of the valve bore.

11. A nozzle assembly as claimed in claim 1, wherein the valve body comprises an upper inlet member having the inlet means and defining an upper valve portion of the valve bore, a valve block attached to the valve inlet member, said valve block defining central and lower portions of the valve bore, and a radial spreader plate attached to the valve block, said spreader plate defining the radial spreading zone and having the valve outlet means of the valve body.

12. A nozzle assembly as claimed in claim 1, wherein the nozzles each comprise a nozzle inlet member coacting with a nozzle outlet means provided in a nozzle plate.

13. A nozzle assembly as claimed in claim 12, wherein the nozzle inlet member defines a bore extending through it from a hose fitting at an inlet end to a tubular portion at the other end of the nozzle bore, the outlet means defining the sump, said tubular portion extending into the sump on assembly of the nozzle inlet member and outlet means.

14. A nozzle assembly as claimed in claim 12, wherein the nozzle outlet means defines an upper annular recess having the sump positioned centrally therein, and a plurality of outlet tubes spaced radially about the sump, the nozzle inlet member and outlet means coacting to provide a flow pathway through the nozzle inlet bore, sump and outlet tubes.

15. A nozzle assembly for dispensing measured volumes of a liquid comprising:

a valve body having valve inlet means for the liquid at a first end and valve outlet means for a plurality of liquid streams at a second end thereof, the valve body defining a valve bore extending from the valve inlet means to a radial spreading zone adjacent the valve outlet means, the valve bore defining an upper cylindrical zone adjacent the valve inlet means, a central zone having a plurality of lobes intersecting at cusps, and a lower cylindrical zone having an aperture opening to the radial spreading zone;

a valve seated in the valve bore of the valve body and coacting with bias means for biasing the valve toward closure of the valve inlet means;

a plurality of nozzles are connected to the valve outlet means, each nozzle having a bore extending from a nozzle inlet to a sump and having a plurality of radially disposed nozzle outlet nipples in flow communication with the sump.

16. A nozzle assembly as claimed in claim 15, wherein the valve inlet is a tubular hose fitting and the valve outlet means is a plurality of tubular hose fittings.

17. A nozzle assembly as claimed in claim 15, wherein the valve outlet means comprises 4, 5 or 6 tubular members extending from the second end of the body.

18. A nozzle assembly as claimed in claim 15, wherein the radial spreading zone is a flat circular space adjacent the valve outlet means.

19. A nozzle assembly as claimed in claim 15, wherein the valve has a stem extending from a valve head into the valve inlet means.

20. A nozzle assembly as claimed in claim 19, wherein the valve stem is offset from the center of the valve head, the stem having at least one longitudinal edge which engages an inner surface of the valve inlet means.

21. A nozzle assembly as claimed in claim 15, wherein the valve has a valve head which in the closed position seats about the valve inlet means closing it.

22. A nozzle assembly as claimed in claim 21, wherein the valve has a circular stop plate stepped down from the valve head, the stop plate being sized to contact the cusps in the central zone of the valve bore when the valve moves to open the valve inlet means.

23. A nozzle assembly as claimed in claim 15, wherein the bias means is a spring.

24. A nozzle assembly as claimed in claim 15, wherein the bias means is a coil spring seated in the lower cylindrical zone of the valve bore.

25. A nozzle assembly as claimed in claim 15, wherein the valve body comprises an upper valve inlet member having the valve inlet means and defining an upper portion of the valve bore, a valve block attached to the valve inlet member, said valve block defining central and lower portions of the valve bore, and a radial spreader plate attached to the valve block, said spreader plate defining the radial spreading zone and having the valve outlet means of the valve body.

26. A nozzle assembly as claimed in claim 15, wherein the nozzles each comprise a nozzle inlet member coacting with a nozzle outlet means provided in a nozzle plate.

27. A nozzle assembly as claimed in claim 26, wherein the nozzle inlet member defines a bore extending through it from a hose fitting at an inlet end to a tubular portion at the other end of the bore, the nozzle outlet means defining the sump, said tubular portion extending into the sump on assembly of the nozzle inlet member and outlet means.

28. A nozzle as claimed in claim 26, wherein the nozzle outlet means defines an upper annular recess having the sump positioned centrally therein, and a plurality of outlet tubes spaced radially about the sump, the nozzle inlet member and outlet means coacting to provide a flow pathway through the nozzle inlet bore, sump and outlet tubes.

29. A nozzle assembly for dispensing measured volumes of a liquid comprising:

a valve body having valve inlet means for the liquid at a first end and valve outlet means for a plurality of liquid streams at a second end thereof, the valve body defining a valve bore extending from the valve inlet means to a radial spreading zone adjacent the valve outlet means;

a valve seated in the valve bore of the valve body and coacting with bias means for biasing the valve toward closure of the valve inlet means;

a plurality of nozzles are connected to the valve outlet means, each nozzle having a bore extending from a nozzle inlet to a sump and having a plurality of radially disposed nozzle outlet nipples in flow communication with the sump, the nozzles each comprising a nozzle inlet member coacting with a nozzle outlet means provided in a nozzle plate, the nozzle inlet member defining a bore extending through it from a hose fitting at an inlet end to a tubular portion at the other end of the bore, the nozzle outlet means defining the sump, said tubular portion extending into the sump on assembly of the nozzle inlet member and outlet means.

30. A nozzle assembly as claimed in claim 29, wherein the valve inlet means is a tubular hose fitting and the valve outlet means is a plurality of tubular hose fittings.

31. A nozzle assembly as claimed in claim 29, wherein the valve outlet means comprises 4, 5 or 6 tubular members extending from the second end of the body.

32. A nozzle assembly as claimed in claim 29, wherein the valve bore of the valve body defines an upper cylindrical zone adjacent the valve inlet means, a central zone having a plurality of lobes intersecting at cusps, and a lower cylindrical zone having an aperture opening to the radial spreading zone.

33. A nozzle assembly as claimed in claim 29, wherein the radial spreading zone is a flat circular space adjacent the valve outlet means.

34. A nozzle assembly as claimed in claim 29, wherein the valve has a stem extending from a valve head into the valve inlet means.

35. A nozzle assembly as claimed in claim 34, wherein the valve stem is offset from the center of the valve head, the stem having at least one longitudinal edge which engages an inner surface of the valve inlet means.

36. A nozzle assembly as claimed in claim 32, wherein the valve has a valve head which in the closed position seats about the valve inlet means closing it.

37. A nozzle as claimed in claim 36, wherein the valve has a circular stop plate stepped down from the valve head, the stop plate being sized to contact the cusps in the central zone of the valve bore when the valve moves to open the valve inlet means.

38. A nozzle assembly as claimed in claim 29, wherein the bias means is a spring.

39. A nozzle assembly as claimed in claim 32, wherein the bias means is a coil spring seated in the lower cylindrical zone of the valve bore.

40. A nozzle assembly as claimed in claim 29, wherein the valve body comprises an upper valve inlet member having the valve inlet means and defining an upper portion of the valve bore, a valve block attached to the valve inlet member, said valve block defining central and lower portions of the valve bore, and a radial spreader plate attached to the valve block, said spreader plate defining the radial spreading zone and having the valve outlet means of the valve body.

41. A nozzle assembly as claimed in claim 29, wherein the nozzle outlet means defines an upper annular recess having the sump positioned centrally therein, and a plurality of outlet tubes spaced radially about the sump, the nozzle inlet member and outlet means coacting to provide a flow pathway through the nozzle inlet bore, sump and outlet tubes.

* * * * *